United States Patent [19]

Patracuolia

[11] Patent Number: 5,018,744

[45] Date of Patent: May 28, 1991

[54] METHOD FOR PLAYING A BOARD GAME

[76] Inventor: Paul A. Patracuolia, 130 Main Street, Orange, N.J. 07050

[21] Appl. No.: 344,467

[22] Filed: Apr. 27, 1989

Related U.S. Application Data

[60] Division of Ser. No. 120,207, Nov. 5, 1987, abandoned, which is a continuation of Ser. No. 898,755, Aug. 13, 1986, abandoned, which is a continuation of Ser. No. 772,152, Sep. 3, 1985, abandoned.

[51] Int. Cl.[5] ..... A63F 3/00; A63F 3/02

[52] U.S. Cl. ..... 273/248; 273/291; 273/260

[58] Field of Search ..... 273/248, 255, 258, 260, 273/262

[56] References Cited

U.S. PATENT DOCUMENTS

| | | | |
|---|---|---|---|
| 519,326 | 5/1894 | Davids | 273/262 |
| 715,474 | 12/1902 | Gaylor | 273/248 |
| 1,204,006 | 12/1916 | Goldmerstein | 273/260 X |
| 1,282,964 | 10/1918 | Simcox | 273/262 |
| 1,303,808 | 5/1919 | Landis | 273/260 |
| 1,492,073 | 4/1924 | Cornell | 273/258 |
| 1,674,533 | 6/1928 | Templeton | 273/260 X |
| 2,743,107 | 4/1956 | Hollossy | 273/290 |
| 2,799,504 | 7/1957 | Keyko | 273/262 |
| 3,433,483 | 3/1969 | Ellis | 273/248 |
| 3,897,953 | 8/1975 | Hovnanian | 273/260 |
| 4,005,866 | 2/1977 | Marcil | 273/260 X |
| 4,019,746 | 4/1977 | Hare | 273/260 X |

FOREIGN PATENT DOCUMENTS 1413568 11/1975 United Kingdom ..... 273/258

OTHER PUBLICATIONS

Essentials of Modern Backgammon, 1975 Found in Group 330 Search Room.

"Essentials of Modern Backgammon", Heines House, 1975: Found in Class 273 Sub 248.

*Primary Examiner*—Benjamin Layno

*Attorney, Agent, or Firm*—Davis Hoxie Faithfull & Hapgood

[57] ABSTRACT

A method and apparatus for playing a board game which includes two distinguishable sets of playing pieces, each set being assigned to one player of the game, and a playing surface divided into a grid-like array of playing spaces, surrounded by a border region. Various playing spaces are distinctively marked so as to create starting spaces, destination spaces, and holding zones for the respective sets of playing pieces. Movement of pieces is governed by the rolling of a pair of dice so designed as to offer fewer permutations than could occur from the rolling of conventional dice, resulting in a game wherein the outcome is relatively less dependent on chance and more dependent on skill. The object of the game is to be the first player to successfully move all of his pieces from the starting spaces, to the destination spaces, and finally into the adjacent border region.

5 Claims, 3 Drawing Sheets

METHOD FOR PLAYING A BOARD GAME

The present application is a divisional of U.S. Ser. No. 07/120/207, filed Nov. 5, 1987 and now abandoned, which in turn was a continuation of U.S. Ser. No. 06/898,755, filed Aug. 13, 1986 and now abandoned, which in turn was a continuation-in-part of U.S. Ser. No. 06/772,152, filed Sept. 3, 1985 and now abandoned.

BACKGROUND OF THE INVENTION

This invention relates to a method and apparatus for playing a board game in which competing players, by means of skill and chance, move a plurality of playing pieces from starting positions to destination zones and thence off the board.

Numerous board games have been created in which two players must move their respective playing pieces in different directions across common territory in order to achieve an ultimate goal, e.g., relocation of all of one's pieces to a remote part of the board. As opposing pieces gain proximity to one another and compete for spaces on the board, confrontations arise in which one player can move his pieces in such a way as to remove one or more of his opponent's pieces from the game, either temporarily or permanently. Examples of this type of game include checkers, chess, and backgammon.

Games of this class have long enjoyed popularity among players of all ages. However, few of these games have combined the factors of skill and chance in the exact proportions necessary to make a particular game not only easy to learn but also continually challenging and entertaining after many hours of play. In some games, e.g., backgammon, the outcome is determined largely by chance, and skill is of little value. Unfortunately, experienced players tend to find that such games, for this very reason, eventually become rather routine and uninteresting. In other games, e.g., chess, the outcome is determined entirely by skill. But because one must master complex strategies in order to succeed, the inexperienced or casual player all too often becomes frustrated and discouraged with such games.

SUMMARY OF THE INVENTION

The present invention, a board game for two players, incorporates both the element of chance and the opportunity for players to develop a broad spectrum of strategies. This ideal combination of features makes for a game at which a player can quickly become proficient and which can be enjoyed by expert and novice alike.

The invention comprises two distinguishable sets of playing pieces, as well as a game board having four sides and a playing surface upon which said pieces are moved as governed by the roll of specially adapted dice. The playing surface is divided into a plurality of playing spaces of equal size, forming a grid-like array, surrounded by a border region.

Two players sit at opposite ends of the board, each looking down upon the plurality of rows and columns of playing spaces. Within the several rows closest to each player at his end of the board are a number of spaces, appropriately marked, which serve as starting spaces for his playing pieces. In one of these same rows, the center-most space is made visually distinguishable, e.g., by color and/or graphic design, and is designated as a "holding zone" for that player's pieces, the significance of which will become apparent below during the discussion of the rules. A preferred embodiment of the game board contains an additional zone for each player's pieces, consisting of all the playing spaces immediately adjacent to that player's "holding zone," forming a circumferential region about the "holding zone." This additional zone is made visually discernible by, e.g., coloring and/or a graphic design. Across the board from each player, in the row most distant from his starting spaces, lie a number of spaces, also visually distinguishable, which serve as destination spaces for his playing pieces. The object of the game is for each player to move his pieces from the starting spaces, across the playing surface, through the defenses of his opponent, into destination spaces, and thence off the board. The first player to do so with all of his pieces is the winner.

The two opposing sets of playing pieces are made distinguishable from each other by some characteristic, e.g., color. Within each set, one playing piece is designated as "superior" to the other pieces and differs in appearance from said other pieces. The remaining pieces are all of a shape, e.g., discoid, which allows any such piece to be readily turned over to reveal either of two faces or surfaces. Each such piece bears two distinct designs, one on each surface, which allows the piece to assume either of two ranks, depending upon which design is exposed. The significance of this duality of rank will become apparent during the discussion of the rules.

Each player operates one pair of dice during the game, this pair preferably corresponding in some characteristic, e.g., color, to his playing pieces. Said dice are of a type specially designed for this game, each die being marked on two surfaces with indicia corresponding to the numeral one, on two surfaces with indicia corresponding to the numeral two, and on two surfaces with indicia corresponding to the numeral three. In comparison with conventional dice, i.e., those marked with indicia corresponding to the numerals one, two, three, four, five, and six on respective surfaces, these special dice greatly reduce the number of permutations available from any roll. Consequently, the outcome of the game becomes less a function of pure chance and more a function of skill.

Finally, the game is equipped with a "doubling cube," bearing the numerals two, four, eight, sixteen, thirty-two, and sixty-four, which aids the players in keeping track of the stakes when the game is played for prizes.

DESCRIPTION OF THE ILLUSTRATED EMBODIMENT

Figure 1:
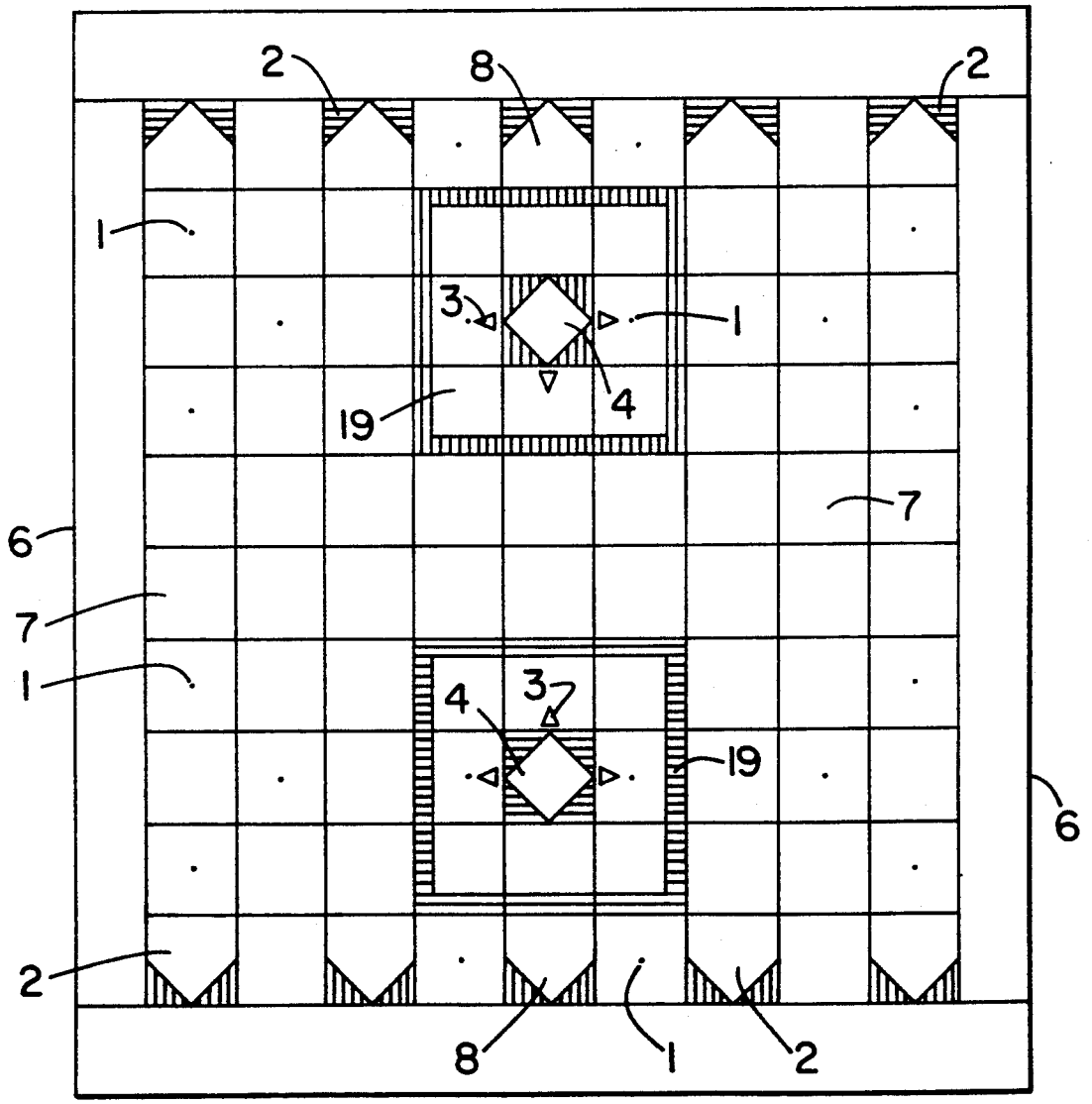
FIG. 1 is a plan view of the game board used in a preferred embodiment of this invention, with certain of the spaces thereon being lined to indicate colors.

Referring to the drawings by numerals of reference, FIG. 1 shows a rectangular game board 6 having a playing surface on which are provided, by printing or the like, suitable indicia as will be described presently.

The playing surface is divided into ninety squares of equal size in a grid of longitudinally and laterally contiguous playing spaces 7. Said playing spaces 7 are arranged into nine columns and ten rows. Each player is allotted ten starting spaces 1, all of which are located within the four rows closest to that player and each of which is clearly marked. At the opposite end of the board 6 from each player are five destination spaces 2, all located in the row closest to the opposing player. Each destination space 2 is made identifiable as such by the use of visually discernible characteristics, e.g., color and/or graphic design.

Different visually discernible characteristics identify the two holding zones 4. One such holding zone 4 is located on each side of the board 6, positioned two spaces in front of the center-most destination space 8. Arrows 3 indicate the directions in which a player can move his playing pieces 9 or 10*a* out of his holding zone 4.

Each holding zone 4 is surrounded by an additional region 19, consisting of the eight playing spaces 7 immediately adjacent to that holding zone 4. Each additional region 19 is made visually distinguishable by, e.g., a graphic design and/or coloring.

Figure 2:
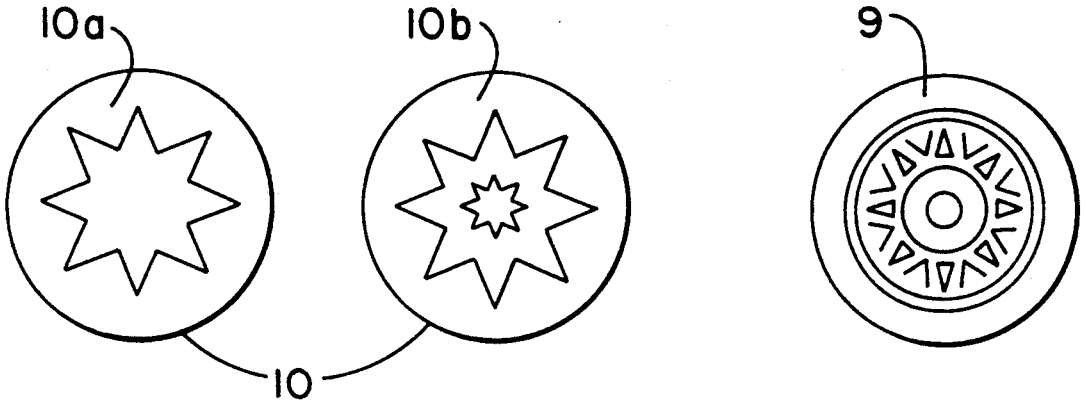
FIG. 2 illustrates distinguishing designs which appear on the surfaces of various discoid playing pieces in one embodiment of the present invention.

Each of the two players is provided with a set of ten playing pieces, each set made visually distinguishable from the other by some characteristic, preferably color. In FIG. 2, three different designs are depicted which, when appearing individually on the exposed face of a discoid playing piece, may be used to indicate, respectively, three different playing ranks. Each player has one playing piece 9 that is designated as superior to the other pieces 10 in that it is able to move about on the playing surface in more directions than said other pieces 10. This superior piece 9 is immediately distinguishable from the ordinary playing pieces 10 by virtue of its unique surface design, and is given a name indicative of its superior rank, e.g., "King." The remaining nine pieces 10 are all of a shape, e.g., discoid, which provides two major surfaces capable of bearing disparate designs. One surface design 10*a* signifies a playing piece of the lowest rank, said piece being named accordingly, e.g., "Pawn." When an ordinary playing piece 10 is turned upside-down, its second surface, bearing alternate design 10*b*, is revealed. Surface design 10*b* signifies a playing piece of intermediate rank, which is given an appropriate name, e.g., "Knight."

Figure 3:
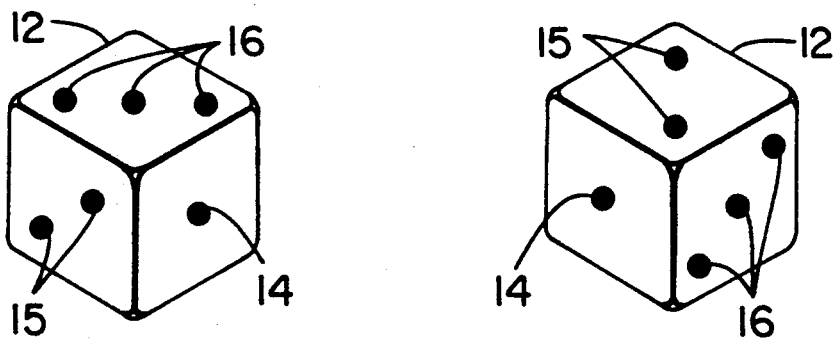
FIG. 3 contains isometric views of two special dice for use in association with the game of the present invention.

In FIG. 3 are shown two special dice 12, of the type which would be used by each player to control the movement of his ten pieces 9 and 10 across the playing surface. Each die 12 has two surfaces 14 marked with pips corresponding to the numeral one, two surfaces 15 marked with pips corresponding to the numeral two, and two surfaces 16 marked with pips corresponding to the numeral three. This special configuration of the dice 12 reduces the likelihood that a player may prevail simply based on luck, i.e., due to consistently high rolls of the dice 12. Thus, in comparison with a game utilizing conventionally numbered dice, i.e., those marked with pips corresponding to numerals one through six, the game of the present invention offers greater challenge.

Figure 4A:
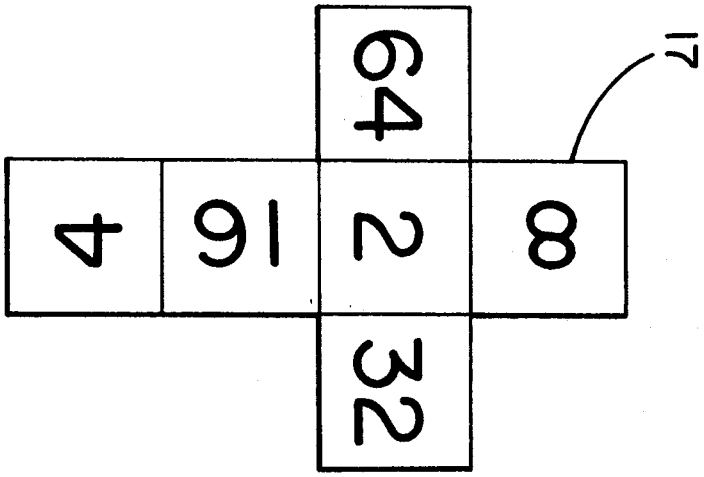
FIG. 4 illustrates a doubling cube which may be used in association with the game of the present invention.
Figure 4B:
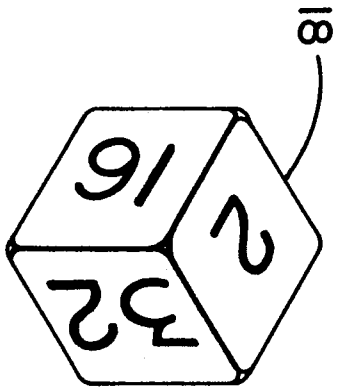

FIG. 4 depicts the doubling cube, which is used by the players to double the betting stakes when the game is played for prizes, in a collapsed view 17 and in an isometric view 18.

METHOD OF PLAY

Each player rolls one die 12 to begin the game. This roll is used only to determine which player will take the first turn; no playing pieces 9 or 10 are moved yet. If the two players should roll the same number, they must each roll again. In a game played for prizes, such a tie results in an automatic doubling of the stakes.

The player rolling the higher number then takes his turn by rolling his two dice 12 and moving his playing piece(s) 9 and/or 10. Pieces 9 and 10 are moved according to the following rules of play:

One or two pieces 9 and/or 10 may be moved by each player at every turn. A single playing piece 9 or 10 may be moved through the number of spaces 7 equal to the sum of the numerical indicia appearing on the two dice 12 rolled. Alternatively, two separate pieces 9 and/or 10 may be moved; the number of spaces 7 that each piece 9 or 10 may move is dictated bY the numerical indicia appearing separately on the respective dice 12.

All playing pieces 9 and 10 may be moved forwards, left, or right, or in any combination thereof. The "King" 9 moves in like manner but may also be moved backwards. No piece 9 or 10 may be moved diagonally.

A playing piece 9 or 10 may jump over a space 7 which is occupied by another playing piece 9 or 10, regardless of whether the latter piece 9 or 10 belongs to the player himself or to the opposing player, as long as the latter piece 9 or 10 is of equal or lower rank. Any such occupied space 7 which is jumped over is counted as part of a move. A playing piece 9 or 10 may not consecutively jump over two or more spaces 7 occupied by pieces belonging to the opposing player.

At no time can two playing pieces 9 or 10 of any rank be located on a single playing space 7 other than a holding zone 4 after a turn is complete.

When a "King" 9 jumps over a "Pawn" 10*a* of the same color, that "Pawn" 10*a* becomes a "Knight" 10*b* for the remainder of the game.

When a "King" 9 jumps over a "Pawn" 10*a* belonging to the opposing player, that "Pawn" 10*a* is sent into the holding zone 4 nearest the opposing player's starting spaces 1. A "Knight" 10*b* can never be sent into this holding zone 4.

A maximum of two "Pawns" 10*a* belonging to a given player can be in that player's holding zone 4 at any one time.

When a "Pawn" 10*a* is in its holding zone 4, the player to which that "Pawn" 10*a* belongs must roll a two on at least one die 12 during his next turn to secure release of that "Pawn" 10*a*. The player must then move the "Pawn" 10*a* the number of spaces 7 equal to the number of pips indicated on the second die 12, in directions given by any of the arrows 3 leading out of the holding zone 4, but only if the "Pawn" 10*a* does not have to jump over a playing piece 9 or 10*b* of higher rank to do so. If the player fails to roll a two on either die 12, he loses his turn and must wait until his next roll of the dice 12 to try again to release the "Pawn" 10*a*. The player may not use his turn to move any playing piece 9 or 10 other than the "Pawn" 10*a* in the holding zone 4.

As an exception to the rule that no playing piece 9 or 10 can ever jump over another piece of higher rank, if two "Knights" 10*b* from different initial positions jump over the opposing player's "Kings" 9 on the same roll of the dice 12, that "Kings" 9 is sent into the opposing player's holding zone 4.

When a "Kings" 9 is in its holding zone 4, the player to which that "Kings" 9 belongs loses one turn. During that player's following turn, he must roll a three on at least one die 12 to secure release of the "Kings" 9 from the holding zone 4. The "Kings" 9 must then be moved the number of spaces 7 equal to the number of pips indicated on the second die 12, in directions given by any of the arrows 3 leading out of the holding zone 4. If the player should fail to roll a three on either die 12, he loses another turn and must wait until his next roll o the dice 12 for another opportunity to remove his "Kings" 9 from the holding zone 4.

When two playing pieces 9 or 10 are in one holding zone 4, only one playing piece 9 or 10 can be removed per turn.

No playing pieces 9 or 10 may be moved through either player's holding zone 4, whether or not either holding zone 4 is occupied. Further, a player's "Kings" 9 may not enter the additional region 19 surrounding the holding zone 4 of his opponent. In addition, one player's pieces 9 or 10 may not move through the opposing player's destination spaces 2. Thus, no playing piece 9 or 10 may be sent back to its holding zone 4 once it has safely reached a destination space 2.

All five of a player's destination spaces 2 must be occupied by that player's pieces 9 or 10 before he can begin moving pieces 9 or 10 off the board. However, once a player has begun moving pieces 9 or 10 off the board, it is not necessary for the player to maintain five occupied destination spaces 2 in order to continue moving pieces 9 or 10 from destination spaces 2 off the board.

A player cannot move any of his pieces 9 or 10 off the board from destination spaces 2 when any of his playing pieces 9 or 10 are in his holding zone 4.

A player's pieces 9 and 10 can only be moved off the board if they were first located in a destination space 2. A player can then use any roll of the dice 12 to move his pieces 9 and 10 from destination spaces 2 off the board; it is not necessary that he roll a one on either die 12. Rather than wait until his next turn to move a playing piece 9 or 10 off the board, a player may elect, within a single turn, to use the roll of his first die 12 to move his piece 9 or 10 into a destination space 2 and to use the roll of his second die 12 to move his piece 9 or 10 off the board.

The game ends when one player has successfully moved all of his pieces 9 and 10 from his assigned destination spaces 2 off the board.

The game may be played for prizes, making use of the doubling cube 17 and 18 to keep track of th betting stakes. As previously noted, automatic doubling occurs whenever a tie occurs during the opening throw of the dice 12. Voluntary doubling may occur when it is a player's turn to play, before he has rolled the dice 12. The offer of voluntary doubling must alternate between the two players. Should one player decline an offer of voluntary doubling, he then loses the game at whatever the stakes were prior to the offer of voluntary doubling.

In conjunction with play for prizes, points may also be awarded to the winning player based upon the number and types of his opponent's pieces 9 and/or 10 remaining on the board 6 at the end of the game. The point scheme to be used in the preferred embodiment of this invention is as follows: one point for a "Pawn" 10*a*, two points for a "Knight" 10*b*, and four points for a "Kings" 9.

I claim:

1. A method for playing a game, said game having a game apparatus comprising two distinguishable sets of playing pieces with each player of the game receiving one of said sets, the pieces within each set being of potentially three disparate playing ranks, a game board having four sides and a playing surface upon which said pieces are positioned and moved, said playing surface being divided into a grid of longitudinally and laterally contiguous playing spaces, a plurality of distinguishable starting spaces to accommodate the playing pieces of each player at the beginning of the game, distinguishable holding zones to which the pieces of each player may be sent during the game by the opposing player so as to impede the movement of said pieces, a plurality of distinguishable destination spaces for the pieces of each player, and a pair of dice used to indicate the number of playing spaces through which said pieces may be moved, the method comprising the steps of:

assigning a set of playing pieces to each player;

determining which player takes the first turn according to who obtains the higher number on a roll of a single die;

starting play by the first player rolling his two dice and moving one or two of his playing pieces through a number of playing spaces corresponding to the numbers showing on the dice;

continuing play by the second player rolling his two dice and moving one or two of his playing pieces in a like fashion;

alternating turns between the two players, each moving his pieces so as to gradually reach destination spaces from starting spaces;

jumping playing pieces over other pieces of either lower or equal rank in order to more directly advance the former across the board.

using a player's piece of highest rank to jump over the opposing player's pieces of lowest rank, causing said opposing pieces to be sent to the appropriate holding zone;

using a player's piece of highest rank to jump over his own pieces of lowest rank, causing said lowest ranking pieces to assume an intermediate playing rank;

using two of a player's pieces of intermediate rank in a single move to jump over the opposing player's piece of highest rank, causing said opposing piece of highest rank to be sent to the appropriate holding zone;

being unable to move a player's pieces through the holding zones assigned to either player;

preparing to move a player's pieces off the playing surface by initially occupying all of the destination spaces assigned to that player with his playing pieces;

being unable to move a player's pieces through the destination spaces assigned to the opposing player; and winning the game by being the first player to move all of his pieces off the playing surface from the destination spaces.

2. The method of claim 1 wherein said game further comprises a doubling cube bearing the numerals two, four, eight, sixteen, thirty-two, and sixty-four, said doubling cube being used by the players to keep track of betting stakes when the game is played for prizes, the method further comprising the steps of:

doubling the stakes automatically whenever a tie occurs during the opening throw of the dice;

offering to the opposing player a voluntary doubling of the stakes, said offer being made during a player's turn, before he has rolled the dice; and alternating between the two players the opportunity to offer said voluntary doubling.

3. The method of claim 1, further comprising the step of:

awarding points to the winning player based upon the number and types of his opponent's pieces remaining on the board at the end of the game.

4. The method of claim 1 wherein said game further comprises two separate border regions at opposite edges of said game board, one of said border regions being adjacent to the destination spaces of each player, the method further comprising the step of:

winning the game by being the first player to move all of his pieces from destination spaces into the adjacent border region.

5. The method of claim 1 wherein said game further comprises distinguishable additional regions each consisting of the group of playing spaces immediately surrounding each holding zone, the method further comprising the step of:

being unable to move a player's piece of highest rank through the additional region surrounding the holding zone assigned to his opponent.

* * * * *

UNITED STATES PATENT AND TRADEMARK OFFICE

CERTIFICATE OF CORRECTION

PATENT NO. : 5,018,744

DATED : May 28, 1991

INVENTOR(S) : Paul A. Patracuolla

It is certified that error appears in the above-identified patent and that said Letters Patent is hereby corrected as shown below:

Column 4, line 19, change "bY" to --by--.

Column 4, line 66, change "kings" to --king--.

Column 4, line 67, change "kings" to --king--.

Column 5, line 1, change "kings" to --king--.

Column 5, line 2, change "kings" to --king--.

Column 5, line 4, change "kings" to --king--.

Column 5, line 5, change "kings" to --king--.

Column 5, line 10, change "o" to --of--.

Column 5, line 11, change "kings" to --king--.

Column 5, line 18, change "kings" to --king--.

Column 5, line 51, change "th" to --the--.

UNITED STATES PATENT AND TRADEMARK OFFICE

CERTIFICATE OF CORRECTION

PATENT NO. : 5,018,744

DATED : May 28, 1991

INVENTOR(S) : Paul A. Patracuolla

It is certified that error appears in the above-identified patent and that said Letters Patent is hereby corrected as shown below:

Column 5, line 67, change "kings" to --king--.

Signed and Sealed this

Twenty-eighth Day of January, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 5,018,744

DATED : May 28, 1991

INVENTOR(S) : Paul A. Patracuolla

It is certified that error appears in the above-identified patent and that said Letters Patent is hereby corrected as shown below:

Title page, left column, top of page, change "Patracuolia" to --Patracuolla--.

Title page, left column, following "Inventor:", change "Patracuolia" to --Patracuolla--.

Signed and Sealed this

Seventh Day of April, 1992

*Attest:*

HARRY F. MANBECK, JR.

*Attesting Officer*

*Commissioner of Patents and Trademarks*